US007387409B1

(12) United States Patent
Beadle

(10) Patent No.: US 7,387,409 B1
(45) Date of Patent: Jun. 17, 2008

(54) PATHWAY LIGHT FIXTURE WITH INTERCHANGEABLE COMPONENTS

(76) Inventor: Joshua Z. Beadle, 4890 Del Mar Mesa Rd., San Diego, CA (US) 92130

( * ) Notice: Subject to any disclaimer, the term of this patent is extended or adjusted under 35 U.S.C. 154(b) by 128 days.

(21) Appl. No.: 11/366,855

(22) Filed: Mar. 1, 2006

(51) Int. Cl.

| | |
|---|---|
| ***F21S 8/00*** | (2006.01) |
| ***F21S 8/08*** | (2006.01) |
| ***E01F 9/00*** | (2006.01) |
| ***F21V 7/00*** | (2006.01) |
| ***F21V 3/00*** | (2006.01) |
| ***F21V 5/00*** | (2006.01) |
| ***F21V 11/00*** | (2006.01) |

(52) U.S. Cl. ..... 362/308; 362/153; 362/153.1; 362/431; 362/310; 362/311; 362/329; 362/359; 362/410

(58) Field of Classification Search ..... 362/153, 362/153.1, 431, 308, 310, 311, 329, 359, 362/410; D26/37, 67
See application file for complete search history.

(56) References Cited

U.S. PATENT DOCUMENTS

| | | | | |
|---|---|---|---|---|
| 1,430,354 | A | 9/1922 | Burdick | |
| 1,500,639 | A | 7/1924 | Rekar | |
| 1,880,399 | A | 10/1932 | Benjamin | |
| 3,194,952 | A * | 7/1965 | Wells | 362/86 |
| 3,363,092 | A * | 1/1968 | Clark et al. | 362/223 |
| 3,833,804 | A * | 9/1974 | Vesely | 362/291 |
| 4,096,555 | A * | 6/1978 | Lasker | 362/302 |
| 4,434,455 | A * | 2/1984 | Merritt | 362/307 |
| 4,464,707 | A | 8/1984 | Forrest | |
| 4,719,548 | A * | 1/1988 | Orosz | 362/309 |
| 4,999,060 | A | 3/1991 | Szekely et al. | |
| 5,025,358 | A | 6/1991 | Cannell | |
| 5,075,828 | A | 12/1991 | Gordin et al. | |
| 5,154,628 | A | 10/1992 | Skegin | |
| 5,226,721 | A | 7/1993 | Stokes | |
| 5,249,109 | A | 9/1993 | Denison et al. | |
| 5,303,127 | A | 4/1994 | Kosann | |
| 5,459,649 | A | 10/1995 | Ellion | |
| 5,481,443 | A | 1/1996 | Wagner et al. | |
| 5,582,479 | A | 12/1996 | Thomas et al. | |

(Continued)

FOREIGN PATENT DOCUMENTS

| | | | |
|---|---|---|---|
| JP | 54063576 | A * | 5/1979 |

*Primary Examiner*—Jong-Suk (James) Lee
*Assistant Examiner*—David J Makiya
(74) *Attorney, Agent, or Firm*—Procopio, Cory, Hargreaves & Savitch, LLP

(57) ABSTRACT

A light fixture for use in low voltage outdoor lighting systems includes a lens assembly with a diffuser lens disposed on top of a lens support, a reflector hood and a mushroom-shaped reflector retaining cap removably mounted on top of the lens assembly. A socket and lamp extend through an opening in the lens support. The radial center of the hood has a flattened area that sits level on top of the cylindrical lens and has an opening through which a base portion of the retaining cap is inserted. A recess in the top of the lens has an opening at its bottom for receiving the base of the retainer cap which is attached with a fastener inserted through the top of the lens. An O-ring seals the lens to the lower surface of the hood and the lens and lens support are sealed to provide a water-resistant seal around the lamp. The lens support is attached to the top of a mounting post.

25 Claims, 5 Drawing Sheets

U.S. PATENT DOCUMENTS 5,718,506 A 2/1998 Yeh
5,791,768 A 8/1998 Splane, Jr.
5,908,236 A 6/1999 Lueken et al.
5,921,663 A * 7/1999 Flammer ..... 362/294
6,033,093 A 3/2000 Latsis et al.
6,113,433 A 9/2000 Al-Turki
6,234,649 B1 5/2001 Katougi
6,357,892 B1 3/2002 Beadle
6,361,193 B1 3/2002 Gabrius et al.
6,422,717 B1 * 7/2002 Beadle ..... 362/285
6,491,407 B1 12/2002 Beadle
6,523,982 B1 * 2/2003 Haddad ..... 362/375
6,612,720 B1 9/2003 Beadle
6,799,869 B1 10/2004 Beadle
6,874,905 B1 4/2005 Beadle
7,021,787 B1 * 4/2006 Kuelbs ..... 362/183
7,182,547 B1 * 2/2007 Leonhardt et al. ..... 404/9
2002/0191391 A1 * 12/2002 Van Etten ..... 362/153

* cited by examiner

PATHWAY LIGHT FIXTURE WITH INTERCHANGEABLE COMPONENTS

FIELD OF THE INVENTION

The invention relates to a light fixture for use in low voltage outdoor lighting systems and more specifically to a pathway light fixture with components that are easily removed and replaced.

BACKGROUND OF THE INVENTION

Environmental lighting, particularly outdoor lighting, is well known in commercial or public settings, such as parks and schools. Such lighting is also popular in residential applications, both to enhance the appearance and safety of the outdoor area and for security, to illuminate dark areas around a building or in a yard which may provide hiding places and unobserved entry points for intruders.

Landscape and outdoor lighting systems include one or more lighting fixtures which are connected to either a 12 V transformer or a standard 120 V AC line. Some lighting fixtures enclose a halogen lamp or conventional bulb within a housing, and include a reflector assembly and a lens or window within the housing. These fixtures may be used for highlighting features such as trees or statues, i.e., up-lighting or for pathway or ground lighting. Other fixtures, used almost exclusively in down-lighting applications, may have an open aspect, where the reflector, and sometimes the lamp and socket are open and directed toward the ground. These fixtures tend to be used in larger quantities within a lighting system since they are typically less expensive than the closed fixtures and are capable of washing large expanses of open area with glare-free light, e.g., pathways, driveways, patios, ground cover plants, and for perimeter lighting.

Pathway down lighting fixtures often have a hood or cowl shaped in the form of a bell, half-shell, cone, tulip, or pyramid that surrounds the lamp except for the lower end of the cowl from which the light emanates. In addition to preventing escape of light in an upward direction, the inner surface of the cowl acts as a reflector to optimize the amount of light directed toward the desired target area.

Outdoor light fixtures are prone to dirt build-up and/or corrosion that can diminish light output and accelerate deterioration and, ultimately, failure of the fixture. In closed fixtures, the effects of dirt build-up and/or oxidation can be reduced by sealing the lamp within a clear or translucent cylinder to create a moisture-proof chamber. To achieve the desired seal, the upper edge of the cylinder is typically glued to the hood using epoxy or silicone adhesive. Any accumulation of material on the cylindrical lens can be easily wiped away to restore full illumination capability. A drawback of the closed fixture designs is that one must disassemble the housing by separating the lens from a base portion to access the lamp for replacement. Another issue with closed fixtures is that the lens can break or crack. Since the lens is glued to the hood, the entire hood/lens assembly must be replaced if one wishes to ensure a well-sealed fixture. An exemplary closed fixture is described in U.S. Pat. No. 6,874,905, of Beadle, which is incorporated herein by reference. In addition to being costly to replace both the lens and metal hood, introduction of a new hood into an established lighting system can detract from the aesthetics of the system since the new hood will not match the other fixtures because is has not weathered or oxidized, for example, to a verde finish in the case of copper.

Another drawback of current commercially available outdoor lighting systems is that such systems will remain in place for years. Due to the expense and effort of replacing an entire set of fixtures, the property owner will keep the same fixtures, even if they would prefer a change in appearance, for example, if the landscape design has changed, or the house or other building has been remodeled or painted a different color.

It would be desirable to provide a pathway light fixture that is attractive, resists breakdown in an outdoor environment, is easy to manufacture and service, and includes easily replaced critical components while still maintaining a good quality seal. The problems and deficiencies are clearly felt in the art and are solved by the present invention in the manner described below.

SUMMARY OF THE INVENTION

It is an advantage of the present invention to provide a pathway light fixture that has a moisture-proof seal to fully enclose the lamp and to protect the lamp and socket against exposure to contaminants.

Another advantage of the present invention is to provide a pathway light fixture that allows for replacement of individual components.

A further advantage of the present invention is to provide a pathway light fixture that provides for changing its appearance without requiring replacement of the entire fixture.

In an exemplary embodiment, the pathway downlight fixture for outdoor installation comprises a post, a socket assembly retained within the top of the stem for retaining a lamp, a lens assembly including a lens support and diffuser lens disposed on top of the stem surrounding the top of the socket assembly, and a hood assembly comprising a hood and reflector retaining cap removably mounted on top of the lens assembly.

The reflector hood is centered over the diffuser lens and flared to capture and reflect light emitted through the lens in a downward direction. The radial center of the hood has a flattened area so that the hood sits level on the top of the cylindrical lens. The center of the flattened top area has an opening therethrough to permit the base portion of the reflector retaining cap to pass through the hood and into a recess in the upper surface of the lens. An opening is formed in the center of the recess for insertion of a fastener to releasably attach the retaining cap to the lens assembly. An O-ring at the top of the lens forms a water-tight seal between the lens and the lower surface of the hood.

In the exemplary embodiment, the socket assembly includes a generally cylindrical socket housing that has a lower portion adapted to fit and be retained within the upper end of the hollow post. In one embodiment, the upper portion is threaded to mate with a threaded recess in the lens support. To provide a watertight seal, an O-ring is disposed between the lens support and the socket housing. In an alternate embodiment, the upper portion of the socket housing has at least two O-ring seats for receiving O-rings to provide an interference fit within the recess in the lower portion of the lens support.

A bore formed along the axial center of the socket housing has an inner diameter for receiving a commercially available socket. Wires connected to the electrical contacts within the socket extend from the socket, passing through the socket housing and post for connection to a voltage source.

The separability of the components of the lens/hood assembly permit the replacement of one or more parts of the assembly without requiring replacement of the entire assembly or fixture. Replacement may be necessitated due to damage to one of the components, or may be desired to give the fixture a different appearance by changing the hood or the reflector retainer cap to another shape, material or finish. In addition, the lens can be replaced if cracked or damaged or if a different color or other optical effect is desired. The water-tight seals provided by the O-rings are readily restored by tightening the appropriate fasteners during reassembly.

BRIEF DESCRIPTION OF THE DRAWINGS

The present invention will be more clearly understood from the following detailed description of the preferred embodiments of the invention and from the attached drawings, in which:

FIGS. 4*a*-4*d* are perspective views of different reflector/retaining cap combinations wherein FIG. 4*a* illustrates a four sided pyramidal shape, FIG. 4*b* illustrates a three sided pyramidal shape, FIG. 4*c* and FIG. 4*d* illustrate different frusto-conical shapes and retaining cap finishes.

DETAILED DESCRIPTION OF THE PREFERRED EMBODIMENTS

Figure 1:
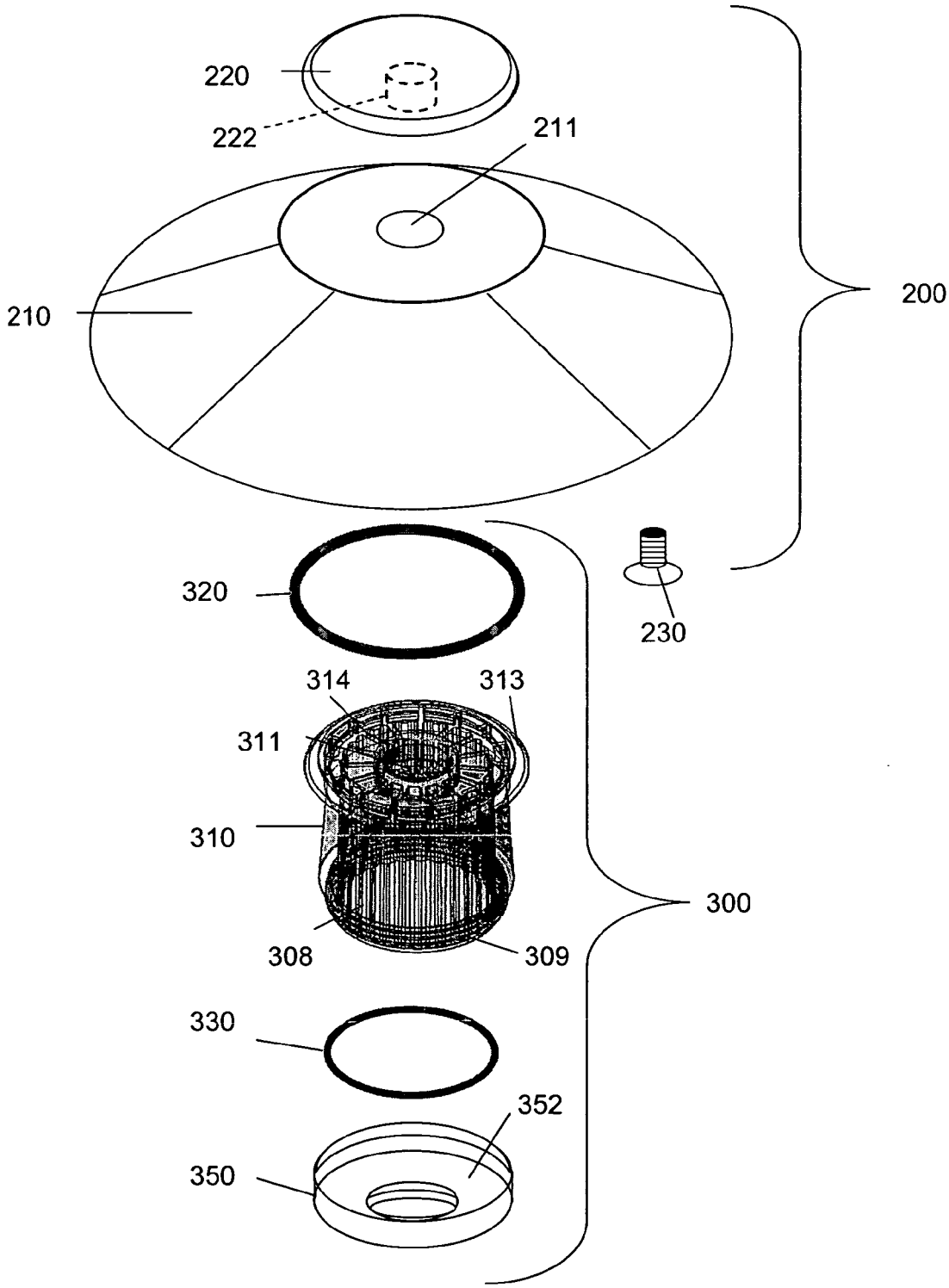
FIG. 1 is an exploded perspective view of a first embodiment of the lens/hood assembly.

FIG. 1 illustrates reflector assembly 200 and lens assembly 300. Reflector assembly 200 includes a reflector hood 210 and a reflector retaining cap 220. Lens assembly 300 is made up of a diffuser lens 310, a top O-ring 320, a bottom O-ring 330, and a lens support 350.

Reflector hood 210 extends radially outward and down relative to diffuser lens 310 to capture and reflect downward the light emitted through diffuser lens 310. At the radial center of the hood is flattened area 212, which has a diameter that generally matches the diameter of lens 310 to allow hood 210 to sit level on top of lens assembly 300. Opening 211 is formed in the center of flattened area 212 to allow insertion of a fastener as described below.

The shape of reflector hood 210 can be varied as long as the general shape is capable of providing an effective down-reflector. Exemplary shapes are provided in FIGS. 4*a*-4*d*, and 5, showing that the hood can be pyramidal, either three-sided, as in FIG. 4*b*, or four-sided, as in FIG. 4*a*, bell shaped, frustoconical, as in FIGS. 4*c* and 4*d*, cylindrical, hemispherical, as in FIG. 5, box shaped, etc. Reflector 210 is preferably formed from a metal such as copper, brass, aluminum, titanium or stainless steel, with finishes where needed to prevent corrosion or to create a desired aesthetic affect, such as a colored paint or powder coating. The reflective surface can be coated or treated to enhance reflectivity, for example, white powder coated, or a coated annular collar can be inserted near the underside of the hood, similar to that described in U.S. Pat. No. 6,799,869 of the present inventor, which disclosure is incorporated herein by reference.

Figure 2:
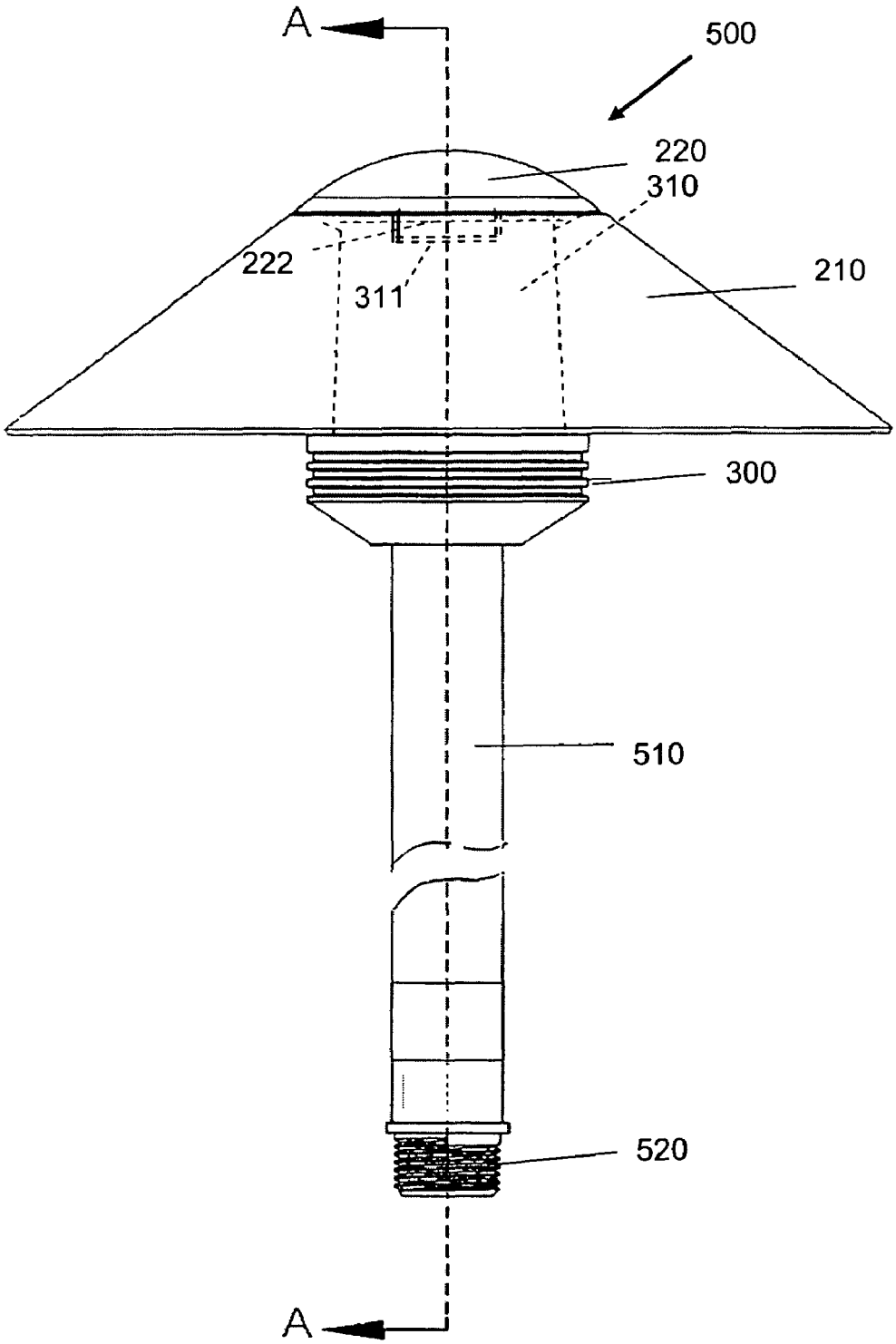
FIG. 2 is a side view of the inventive lighting fixture.
Figure 3:
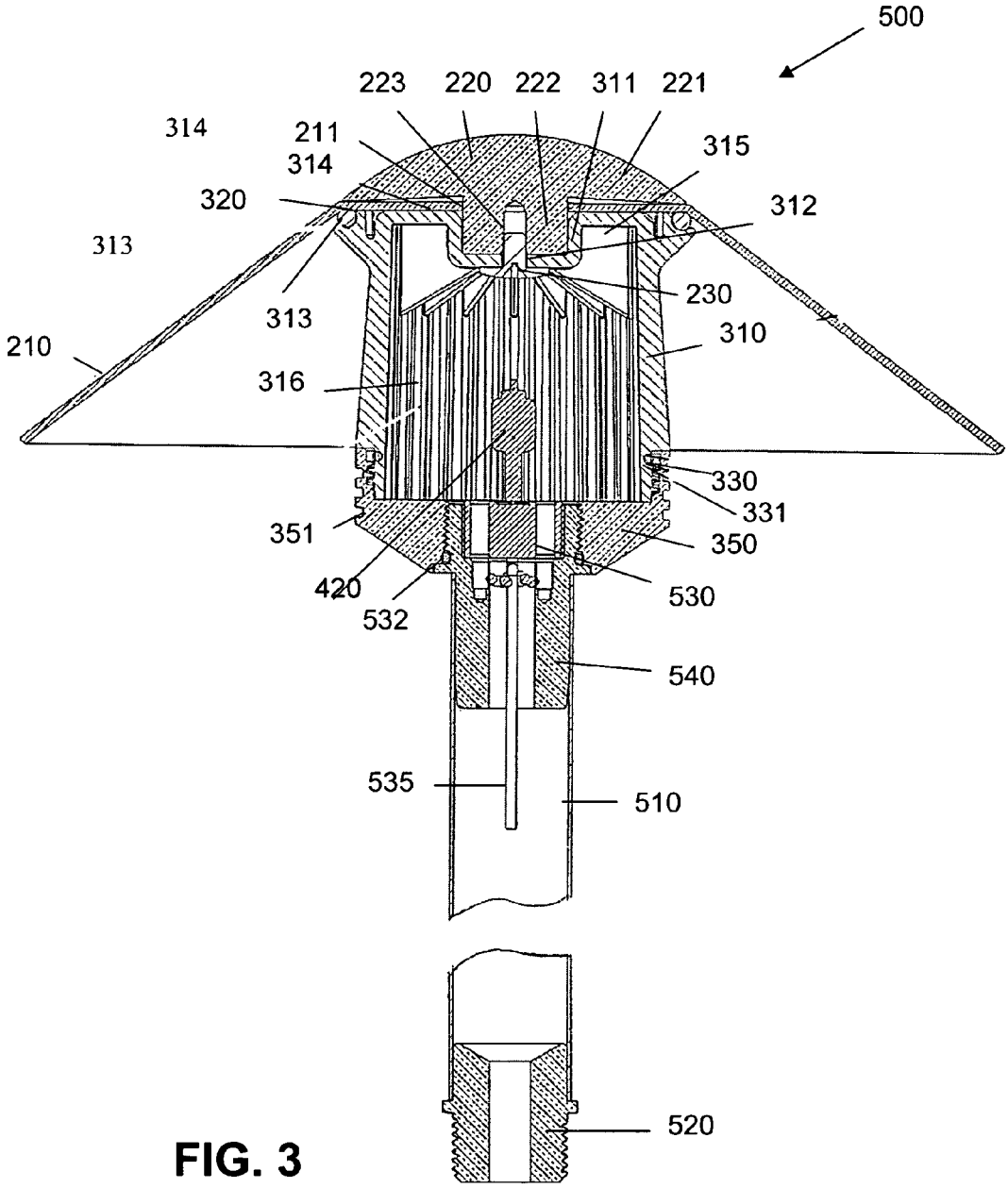
FIG. 3 is a cross-sectional view of the lighting fixture taken along line A-A of FIG. 2 showing the first embodiment of the invention.
Figure 4A:
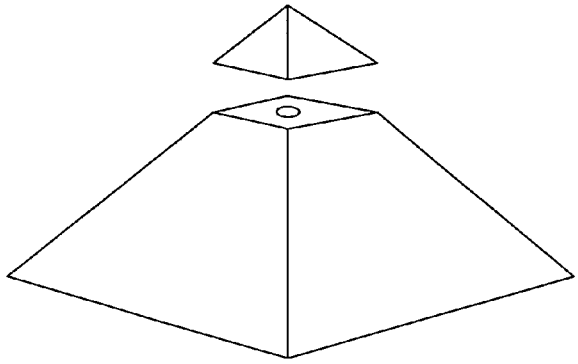
Figure 4B:
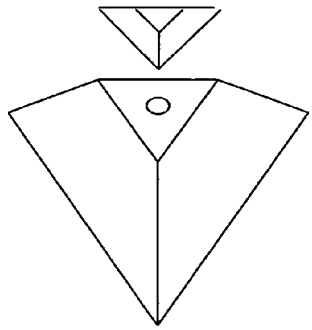
Figure 4C:
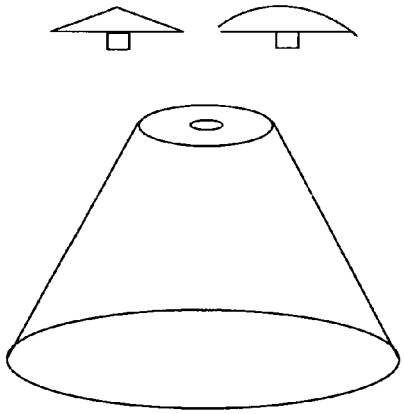
Figure 4D:
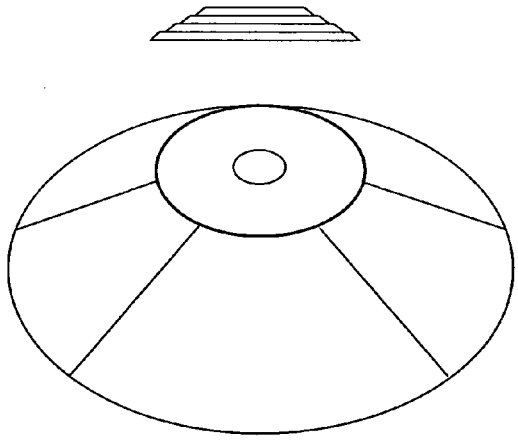

FIGS. 2 and 3 illustrate a fully assembled lighting fixture 500. As shown, reflector hood 210 is frustoconical in shape and retaining cap 220 is convex with a diameter and curvature selected to create the appearance of a continuous curved line when the fixture is assembled. The lower portion of lens assembly 300, post 510, and threaded end plug 520 are displayed.

Reflector retaining cap 220 is generally mushroom shaped, having a "T"-like cross section with a head 221 and a stem 222. Stem 222 has a diameter selected to closely fit through reflector hood opening 211 and into recess 311 in the upper surface 314 of diffuser lens 310. Head 221, which is typically tapered or convex, has a largest outer dimension larger than that of stem 222 and which generally matches the dimensions of flattened area 212, so that flattened area 212 is covered on its exterior by the base of head 221. A bore 223 is formed in the lower edge of stem 222 and is preferably threaded to mate with threads of retaining screw 230 to fasten reflector hood 210 to lens assembly 300.

In the preferred embodiment of the present invention, reflector retaining cap 220 is made from brass by CNC machining or other machining techniques known in the art. Reflector retaining cap 220 may be made from other metals such as copper, stainless steel, chromed steel, or plastics and polymers and may be formed by machining or molding. The material may be selected to either contrast with or to match the material and finish of reflector hood 210, and may be finished with a protective coating as appropriate. The shape of retaining cap 220 may be selected to continue the profile of the hood, for example, as in FIGS. 2, 4*a* and 5, or to provide a different appearance, such as the ribbed, flat top cap shown in FIG. 4*d*.

Diffuser lens 310 is generally cylindrical in shape having an upper end 314 and a lower end 308. In the preferred embodiment, upper end 314 is closed with a recess 311 formed at its radial center to accept stem 222 of reflector retaining cap 220. An opening 312 is formed at the center of recess 311 for insertion of retaining screw 230. The top surface of upper end 314 serves as a seat to support flattened area 212 of reflector hood 210. Reflector hood 210 sits on reflector seat 314 and is secured in place by reflector retaining cap 220 and retaining screw 230, which is inserted through opening 312 and screwed into bore 223.

In the preferred embodiment, upper end 314 flares outward and an annular ring forms O-ring seat 313 in the outer edge of the top surface. O-ring 320 is retained within O-ring seat 313, forming a moisture tight seal between the reflector hood 210 and the diffuser lens 310. The compression of O-ring 320 when screw 230 is tightened also prevents rotation of the hood as a result of the frictional force generated between the O-ring and the inner surface of the hood. A plurality of radial fins 315 may be formed on the inside surface of upper end 314 to provide structural reinforcement of recess 311. In addition to the flare at upper end 314, diffuser lens 310 may be tapered slightly outward from the upper end to the lower end.

Lower end 308 of diffuser lens 310 is retained within the upper portion of lens support 350. In the preferred embodiment, lower end 308 is threaded to mate with matching threads in recess 352 of lens support 350. O-ring seat 331 is formed at the top of the threaded portion 309 of lower end 308 to receive O-ring 330, which provides a water-tight seal between diffuser lens 310 and lens support 350. In an alternate embodiment, lower end 308 may have a smooth surface and/or may have one or more O-ring seats for receiving O-rings that create an interference fit within the slightly larger inner diameter of recess 352. An adhesive such as epoxy may also be used to attach lens 310 within lens support 350 for a permanent bond.

Diffuser lens 310 can be transparent or translucent, e.g., frosted or etched, glass, plastic, or similar material, impact resistant, and capable of withstanding outside environmental conditions without degradation. In a preferred embodiment, the diffuser lens 310 is made of injection molded polycarbonate, such as Lexan®. A plurality of longitudinal ribs or other surface topography may be formed on the inner surface of the lens to act as diffusers.

Figure 5:
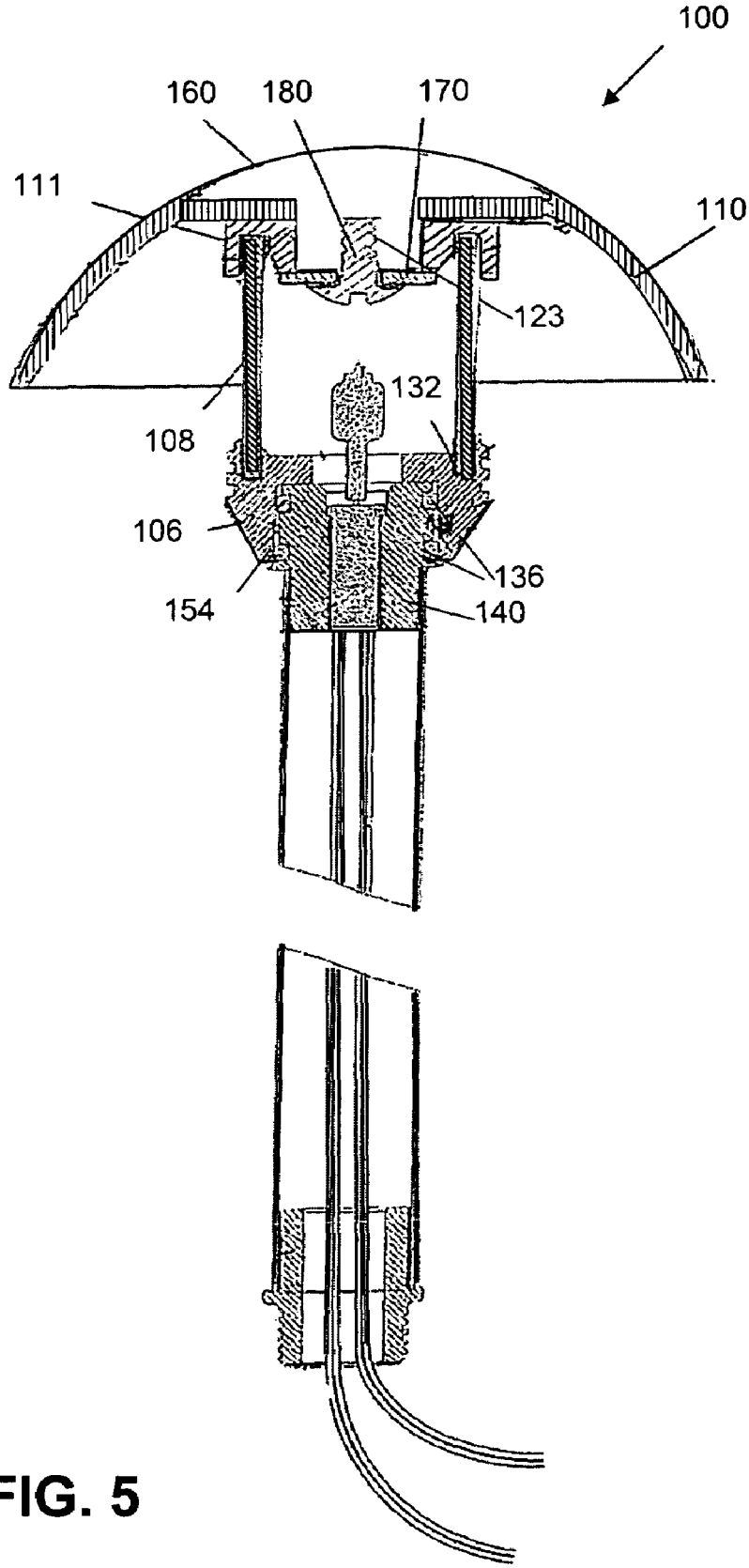
FIG. 5 is a cross-sectional view of the lighting fixture taken along line A-A of FIG. 2 showing a second embodiment of the lighting fixture.

Lens support 350 has an upper portion, with recess 352, a lower portion, and has an exterior shape that is generally cylindrical with a beveled edge. Annular channels 351 may be formed in the outer surface for primarily aesthetic reasons, however, such channels can facilitate gripping the lens assembly 300 during disassembly and reassembly of the lighting fixture 500. Concentric bore 354 is formed in the lower portion for attachment to the top of post 510. As illustrated in FIG. 3, bore 354 is threaded to mate with matching threads on the top of socket housing 540. An O-ring 536 is disposed between bore 354 and the lower flange of socket housing 540 to form a watertight seat. In the embodiment of FIG. 5, bore 154 is slightly tapered to fit over and create an interference fit with the two O-rings 136 that are retained in O-ring seats formed in socket housing 140.

In the preferred embodiment of the present invention, lens support 350 is made from CNC machined brass. Lens support 350 may be made from other metals such as copper, stainless steel, chromed steel, or plastics and may be formed by machining or molding.

In an alternate embodiment illustrated in FIG. 5, diffuser lens 108 is an open cylinder, preferably formed from frosted or etched glass. Reflector support 111, which may be metal, such are brass, or plastic or polymer, is disposed over the top edge of diffuser lens 108, held in place with an adhesive. Reflector support 111 has a recess formed at the radial in its upper surface for receiving the stem of retaining cap 160. The recess has an opening therethrough to permit insertion of retaining screw 180 into threaded bore 123 in retaining cap 160, providing the same function as upper portion 314 of the lens 310 in the embodiment of FIGS. 1-3. If the opening in reflector support 111 is larger than the head of screw 180, a retaining washer 170 is used. Retaining screw 180 is inserted through washer 170, and screwed into bore 123. The lower end of diffuser lens 108 is disposed to the annular channel 132 in the upper portion of the lens support 106 and held in place with and adhesive or may be attached as described above for the embodiment of FIGS. 1-3.

Lens support 350 or 106 is connected to the upper end of post 510 by way of socket housing 540 or 140, respectively for the two exemplary embodiments. Attachment may be effected by mating threads, a slip fit with O-rings, or an interference fit.

Lamp socket 530 is disposed into the socket housing 540 and is formed from a non-conductive body of plastic or other durable, non-conductive materials such as ceramic. A pair of metal conductors 535 passes through the post 510 and attach to the lamp socket 530. Lamp socket 530 is configured to receive the conductive prongs of a lamp 420. Lamp 420 is preferably a halogen filament-type lamp but can also be xenon, tungsten filament, incandescent, or other comparable lamp commonly used in similar lighting applications. The voltage supply (not shown), is preferably a low voltage (12V) transformer which is connected to 120 VAC. The conductive wires enter extend out the bottom of the post 510 to provide for connection to a low voltage cable and voltage source, such as a transformer. In the preferred embodiment, lamp socket 530 is commercially-available from BJB of Amsberg, Germany, as Part No. 25.144.1121.90, which is a lamp holder with a push fixing for a 7.8 mm cut out. Selection of other types of lamps and sockets of similar specifications will be apparent to those of skill in the art.

The need to disassemble the upper portion of the light fixture for maintenance or aesthetic purposes, e.g., changing the diffuser lens assembly due to breakage, changing the reflector hood for an alternate appearance, or replacing a burnt out lamp typically arises after the fixture has been mounted in place in the outdoor setting. When lighting fixture 500 is fully assembled, any of the components of the reflector assembly 200, the lens assembly 300, or the lamp 420 may be replaced individually by removing the lens assembly 300 from the post 510, then removing the reflector assembly 200 from the lens assembly 300, and disassembling the lens assembly 300. The process is reversed to put the lighting fixture 500 back together.

Post 510 has an upper end, a lower end, and a substantially hollow interior through which the conductive wires pass to provide a connection to a cable connected to a voltage source (not shown). The lower end of post 510 may have an end plug 520 for attachment of the fixture to a mounting device. End plug 520 has a central bore and a threaded portion. In the preferred embodiment, the threaded portion has external threads of a standard thread pattern, e.g., ½" NPS male thread, which cooperate with female threads of a molded plastic ground spike which can then be interned into the ground. In this exemplary installation (not shown), conductive wiring, or preferably a low voltage burial-type cable connected to the conductive wiring exits the lower end of post 510 through the central bore, is threaded through an opening in the ground spike, and then continues to termination at the transformer. Other forms of mounting the fixture in place will be readily apparent to those of skill in the art, including mounting the fixture on a riser which may be attached to a ground spike or to another support.

In the preferred embodiment, post 510 is formed from solid copper, which is intended to oxidize to a verde finish and, thus, is preferably uncoated. Other corrosion resistant materials may be used as well, including stainless steel, anodized aluminum, powder-coated or painted metal, or high temperature plastics or composites.

The foregoing description of preferred embodiments is not intended to be limited to the specific details disclosed herein. Rather, the present invention extends to all functionally equivalent structures, methods and uses as fall within the scope of the appended claims.

What is claimed is:

1. A light fixture, comprising:

a lens assembly comprising:

a lens having a generally cylindrical shape with an upper end, a lower end, and an outer diameter, the upper end defining a support area with a recess having an opening centered therein;

a lens support having an upper portion and a lower portion, wherein the upper portion has a recessed area for enclosing and supporting the lower end of the lens; and seal means for sealing the lens to the lens support;

a reflector assembly comprising:

a reflector hood having a hood diameter much larger than the outer diameter of the lens so that light emitted through the lens is reflected in a downward direction, the hood having a flattened area at its center with a hood opening therethrough, the flattened area having a diameter much smaller than the hood diameter and slightly larger than the outer diameter of the lens so that the flattened area is supported on the support area of the lens;

a retaining cap having a head portion and a stem portion, the stem portion having an outer diameter dimensioned to pass through the hood opening to be received in the recess in the support area, wherein the stem portion has a central bore formed therein, and wherein the head portion has an outer diameter substantially the same as the diameter of the flattened area to cover the flattened area of the hood;

a fastener for releasably fastening the reflector assembly to the lens assembly, wherein the fastener is inserted through the opening in the recess from an interior of the lens and into the central bore of the retaining cap;

a socket assembly for retaining a lamp, the socket assembly extending into the lower portion of the lens assembly for attachment to the lens support; and a post for supporting the socket assembly.

2. The light fixture of claim 1, wherein the seal means is releasable and comprises an external threaded area formed on an outer surface of the lower portion of the lens for mating with an internal thread formed in an inner surface of the recessed area in the lens support.

3. The light fixture of claim 2, wherein the seal means further comprises an O-ring seat formed in the lower portion of the lens, above the external threaded area and an O-ring disposed within the O-ring seat.

4. The light fixture of claim 1, wherein the reflector assembly further comprises a reflector/lens seal means for providing a releasable watertight seal between the reflector hood and the lens.

5. The light fixture of claim 4, wherein the reflector/lens seal means comprises an O-ring seat formed near the upper portion of the lens and an O-ring retained within the O-ring seat, wherein tightening of the fastener compresses the O-ring against an inner surface of the reflector hood.

6. The light fixture of claim 1, wherein the lens is injection molded polycarbonate.

7. The light fixture of claim 6, wherein the lens includes a plurality of diffuser ribs.

8. The light fixture of claim 1, wherein the seal means comprises an adhesive.

9. The light fixture of claim 1, wherein the reflector hood is formed from copper.

10. The light fixture of claim 1, wherein the reflector hood is formed from powder-coated metal.

11. The light fixture of claim 1, wherein the retaining cap is formed from brass.

12. A light fixture, comprising:

a lens support having an upper portion and a lower portion, the upper portion having a recessed area with an inner diameter;

a socket assembly for retaining a lamp retained within the lens support;

a lens having a generally cylindrical shape with an upper end, a lower end and an outer diameter so that the lower end fits within the recessed area in the lens support, the upper end having a flat support area with a recess having an opening centered therein;

a reflector hood having a hood diameter much larger than the outer diameter of the lens so that light emitted through the lens is reflected in a downward direction, the hood having a flattened area at its center with a hood opening therethrough, the flattened area having a diameter much smaller than the hood diameter and slightly larger than the outer diameter of the lens so that the flattened area is supported on the support area of the lens;

a retaining cap having a head portion and a stem portion, the stem portion having an outer diameter dimensioned to pass through the hood opening to be received in the recess in the support area, wherein the stem portion has a central bore formed therein for receiving a fastener, and wherein the head portion has an outer diameter substantially the same as the diameter of the flattened area to cover the flattened area of the hood;

a fastener for releasably fastening the reflector assembly to the lens assembly, wherein the fastener is inserted through the opening in the recess from an interior of the lens and into the central bore of the retaining cap;

and a post for supporting the socket assembly.

13. The light fixture of claim 12, further comprising a releasable seal means for sealing the lens to the lens support.

14. The light fixture of claim 13, wherein the seal means comprises an external threaded area formed on an outer surface of the lower portion of the lens for mating with an internal thread formed in an inner surface of the recessed area in the lens support.

15. The light fixture of claim 14, wherein the seal means further comprises an O-ring seat formed in the lower portion of the lens, above the external threaded area and an O-ring disposed within the O-ring seat.

16. The light fixture of claim 12, further comprising a reflector/lens seal means for providing a releasable watertight seal between the reflector hood and the lens.

17. The light fixture of claim 16, wherein the reflector/lens seal means comprises an O-ring seat formed near the upper portion of the lens and an O-ring retained within the O-ring seat, wherein tightening of the fastener compresses the O-ring against an inner surface of the reflector hood.

18. The light fixture of claim 12, wherein the lens is injection molded polycarbonate.

19. The light fixture of claim 18, wherein the lens includes a plurality of diffuser ribs.

20. The light fixture of claim 12, wherein the reflector hood is formed from copper or powder-coated metal.

21. The light fixture of claim 12, wherein the retaining cap is formed from brass.

22. The light fixture of claim 1, wherein the lens comprises an open cylinder having a reflector support affixed thereto, wherein the reflector support defines the support area.

23. The light fixture of claim 1, wherein the reflector hood further comprises a reflective annular collar disposed on an underside of the reflector hood.

24. The light fixture of claim 12, wherein the lens comprises an open cylinder having a reflector support affixed thereto, wherein the reflector support defines the support area.

25. The light fixture of claim 12, wherein the reflector hood further comprises a reflective annular collar disposed on an underside of the reflector hood.

* * * * *